US010892082B2

(12) United States Patent
Metzler et al.

(10) Patent No.: US 10,892,082 B2
(45) Date of Patent: Jan. 12, 2021

(54) SYSTEMS AND METHODS FOR COOLING TOROIDAL MAGNETICS

(71) Applicant: HAMILTON SUNDSTRAND CORPORATION, Charlotte, NC (US)

(72) Inventors: Mark W. Metzler, Davis, IL (US); Debabrata Pal, Hoffman Estates, IL (US); Mustansir Kheraluwala, Lake Zurich, IL (US); Charles Patrick Shepard, DeKalb, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 15/839,628

(22) Filed: Dec. 12, 2017

(65) Prior Publication Data

US 2019/0180908 A1 Jun. 13, 2019

(51) Int. Cl.

| | |
|---|---|
| ***H01F 27/28*** | (2006.01) |
| ***H01F 27/10*** | (2006.01) |
| ***H01F 17/06*** | (2006.01) |
| ***H01F 27/34*** | (2006.01) |
| ***H01F 27/30*** | (2006.01) |
| ***H01F 27/02*** | (2006.01) |
| ***H01F 27/06*** | (2006.01) |

(52) U.S. Cl.

CPC ..... *H01F 27/105* (2013.01); *H01F 17/062* (2013.01); *H01F 27/025* (2013.01); *H01F 27/06* (2013.01); *H01F 27/10* (2013.01); *H01F 27/2876* (2013.01); *H01F 27/2895* (2013.01); *H01F 27/30* (2013.01); *H01F 27/346* (2013.01)

(58) Field of Classification Search

USPC ..... 336/229, 57

See application file for complete search history.

(56) References Cited

U.S. PATENT DOCUMENTS 3,137,829 A * 6/1964 Dillow ..... H01F 27/08 336/57
4,035,751 A * 7/1977 Walthew ..... H01F 27/24 336/60

(Continued)

FOREIGN PATENT DOCUMENTS

| | | |
|---|---|---|
| EP | 2642131 | 9/2013 |
| EP | 2648194 | 10/2013 |

OTHER PUBLICATIONS

European Patent Office, European Search Report dated Apr. 18, 2019 in Application No. 18211915.6.

(Continued)

*Primary Examiner* — Ronald Hinson

(74) *Attorney, Agent, or Firm* — Snell & Wilmer LLP

(57) ABSTRACT

An inductor housing for housing an inductor having a core and a winding includes an outer annular wall and a third wall extending inward from the outer annular wall such that the outer annular wall and the third wall at least partially define an annular cavity configured to receive the inductor. The inductor housing further includes an attachment feature configured to couple the inductor housing to a secondary housing. The inductor is configured to be enclosed within the annular cavity and the secondary housing, and coolant from a coolant supply is configured to flow past the annular cavity and contact the winding of the inductor.

14 Claims, 8 Drawing Sheets

(56) References Cited

U.S. PATENT DOCUMENTS

| | | | | |
|---|---|---|---|---|
| 5,689,182 | A * | 11/1997 | Togo | G01D 11/245 29/602.1 |
| 5,814,986 | A * | 9/1998 | Goskowicz | G01B 7/023 29/606 |
| 6,982,619 | B2 * | 1/2006 | Nussio | F02M 59/366 335/262 |
| 9,299,488 | B2 | 3/2016 | Shepard et al. | |
| 9,524,820 | B2 | 12/2016 | Jacobson et al. | |
| 2011/0267161 | A1 * | 11/2011 | MacLennan | H01F 27/105 336/58 |
| 2013/0257574 | A1 * | 10/2013 | Downing | H01F 17/062 336/57 |
| 2014/0175916 | A1 | 6/2014 | Chamberlin et al. | |
| 2015/0228401 | A1 * | 8/2015 | Ratz | H01F 27/324 336/92 |
| 2016/0005521 | A1 * | 1/2016 | Pal | H01F 27/02 336/60 |

OTHER PUBLICATIONS

European Patent Office, European Office Action dated Jan. 24, 2020 in Application No. 18211915.6.

* cited by examiner

SYSTEMS AND METHODS FOR COOLING TOROIDAL MAGNETICS

FIELD

The present disclosure is directed to systems and methods for cooling inductors and, more particularly, to systems and methods for cooling toroidal inductors via direct contact between the toroidal inductors and a coolant.

BACKGROUND

Inductors may be used for various purposes such as for filtering a power signal. For example, a generator may output a power signal that may be relatively uneven or may include a noise element. An inductor may be connected downstream from the generator and may be used to filter the power signal. Based on the characteristics of the inductor, heat dissipation during operation, and the environment in which the inductor is used, the inductor temperature may exceed maximum allowable limits. In that regard, it is desirable to effectively transfer heat from the inductor to reduce the likelihood of damage to the inductor or the environment of the inductor.

SUMMARY

Described herein is an inductor housing for housing an inductor having a core and a winding. The inductor housing includes an outer annular wall and a third wall extending inward from the outer annular wall such that the outer annular wall and the third wall at least partially define an annular cavity configured to receive the inductor. The inductor housing further includes an attachment feature configured to couple the inductor housing to a secondary housing. The inductor is configured to be enclosed within the annular cavity and the secondary housing, and coolant from a coolant supply is configured to flow past the annular cavity and contact the winding of the inductor.

In any of the foregoing embodiments, the attachment feature includes an attachment boss that defines a first O-ring groove configured to receive a first O-ring to reduce the likelihood of the coolant leaking between the attachment boss and the secondary housing.

Any of the foregoing embodiments may also include an inner annular wall located radially inward from the outer annular wall and at least partially defining the annular cavity, and a potting material configured to be positioned between the inductor and the inner annular wall, and between the inductor and the outer annular wall.

In any of the foregoing embodiments, the outer annular wall defines a via configured to receive a lead of the inductor such that the lead extends through the potting material and the via, the potting material reducing the likelihood of the coolant leaking through the via.

Any of the foregoing embodiments may also include an inner annular wall located radially inward from the outer annular wall and at least partially defining the annular cavity, and a coolant channel defined radially inward from the inner annular wall, wherein the inner annular wall further defines a coolant hole in fluid communication with the coolant channel such that the coolant is configured to flow from the coolant supply, through the coolant channel and the coolant hole and towards the outer annular wall.

In any of the foregoing embodiments, the inner annular wall further defines a second O-ring groove configured to receive a second O-ring to reduce the likelihood of the coolant leaking between the inner annular wall and the secondary housing.

In any of the foregoing embodiments, the coolant hole includes multiple sets of coolant holes.

In any of the foregoing embodiments, the coolant hole forms an angle that is greater than 0 degrees and less than 90 degrees relative to the third wall.

Any of the foregoing embodiments may also include a face seal configured to be compressed between the inner annular wall and the secondary housing to reduce the likelihood of the coolant leaking between the inner annular wall and the secondary housing.

Any of the foregoing embodiments may also include an inner annular wall located radially inward from the outer annular wall and at least partially defining the annular cavity, and a fourth wall extending radially inward from the inner annular wall such that a coolant flowpath is defined between the secondary housing and the fourth wall such that the coolant flows from the coolant supply into the coolant flowpath, and from the coolant flowpath into the annular cavity and past the winding of the inductor.

Also disclosed is a system for cooling electronics. The system includes an inductor having a core and a winding. The system also includes an inductor housing defining a cavity having a shape configured to at least partially receive the inductor. The system also includes a secondary housing shaped and configured to be sealingly attached to the inductor housing to facilitate coolant within the secondary housing fluidically engaging with the winding.

In any of the foregoing embodiments, the inductor housing includes an inner annular wall, an outer annular wall, and a third wall extending from the inner annular wall to the outer annular wall such that the inner annular wall, the outer annular wall, and the third wall define the cavity.

In any of the foregoing embodiments, the inductor housing further includes an attachment boss extending away from the outer annular wall and configured to be coupled to the secondary housing.

In any of the foregoing embodiments, the attachment boss defines a first O-ring groove configured to receive a first O-ring to reduce the likelihood of the coolant leaking between the attachment boss and the secondary housing.

Any of the foregoing embodiments may also include a potting material located between the inductor and the outer annular wall, wherein the outer annular wall defines a via configured to receive a lead of the inductor such that the lead extends through the potting material and the via, the potting material reducing the likelihood of the coolant leaking through the via.

Any of the foregoing embodiments may also include a coolant channel defined radially inward from the inner annular wall, wherein the inner annular wall further defines a coolant hole configured to receive the coolant from the secondary housing.

Also disclosed is a system for cooling an inductor having a winding. The system includes a secondary housing having a coolant supply configured to provide a coolant. The system also includes an inductor housing defining a cavity having a shape configured to at least partially receive the inductor and having an attachment feature configured to couple the inductor housing to the secondary housing, such that the coolant may flow from the secondary housing through at least a portion of the cavity and contact the winding.

In any of the foregoing embodiments, the inductor housing includes an inner annular wall, an outer annular wall, and a third wall extending from the inner annular wall to the outer annular wall such that the inner annular wall, the outer annular wall, and the third wall define the cavity.

In any of the foregoing embodiments, the inductor housing further includes an attachment boss extending away from the outer annular wall, configured to be coupled to the secondary housing, and defining a first O-ring groove configured to receive a first O-ring to reduce the likelihood of the coolant leaking between the attachment boss an the secondary housing.

Any of the foregoing embodiments may also include a potting material configured to be located between the inductor and the outer annular wall, wherein the outer annular wall defines a via configured to receive a lead of the inductor such that the lead extends through the potting material and the via, the potting material reducing the likelihood of the coolant leaking through the via.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosures, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1A:
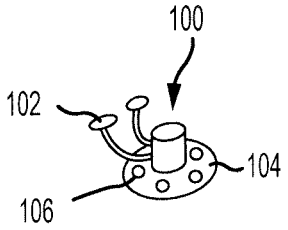
FIG. 1A illustrates an inductor housing, in accordance with various embodiments of the present disclosure.
Figure 1B:
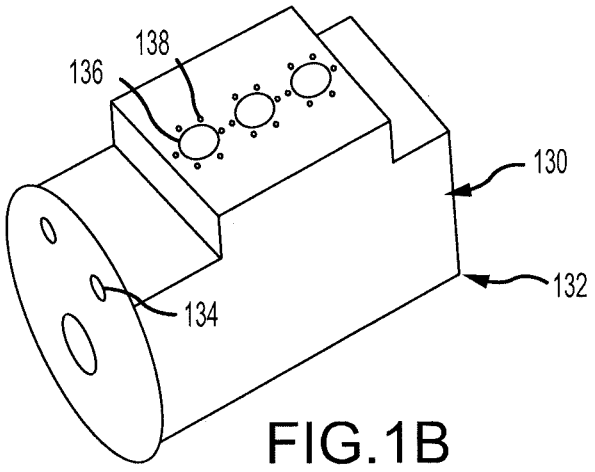
FIG. 1B illustrates a generator housing as a secondary housing for use with the inductor housing of FIG. 1A, in accordance with various embodiments of the present disclosure.

Referring to FIGS. 1A and 1B, an inductor housing 100 may be designed to house an inductor (such as a toroidal inductor 200 shown in FIG. 2) and may be coupled to a secondary housing 130. For example, the secondary housing 130 may be a generator housing 132 that houses a generator, and the inductor may be used to filter an electrical signal generated by the generator. The secondary housing 130 may include coolant lines 134 that provide coolant to reduce a temperature of the inductor.

The inductor housing 100 may include an attachment feature, such as an attachment boss 104, usable to couple the inductor housing 100 to the secondary housing 130. The inductor housing 100 may be coupled to a mounting location 136 of the secondary housing 130. The attachment boss 104 may define boss apertures 106 that align with secondary apertures 138 of the secondary housing 130. Bolts, screws, or other fasteners may extend through the boss apertures 106 and the secondary apertures 138 to fasten the inductor housing 100 to the secondary housing 130.

Leads 102 of the inductor may extend through the inductor housing 100 and may be used to electrically couple the inductor to an external component.

Figure 1C:
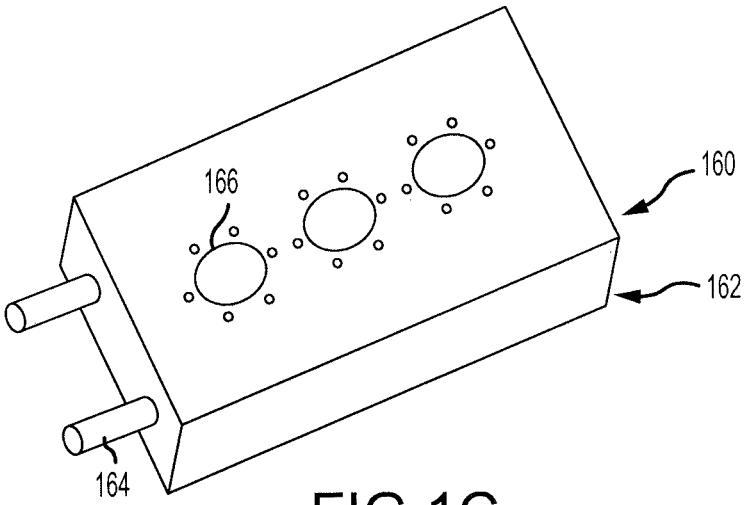
FIG. 1C illustrates a heat sink as a secondary housing for use with the inductor housing of FIG. 1A, in accordance with various embodiments of the present disclosure.

Referring to FIGS. 1A and 1C, the inductor housing 100 may also be designed to be coupled to another secondary housing 160. For example, the secondary housing 160 may be a heat sink 162 that likewise includes a mounting location 166 and coolant lines 164.

Figure 2:
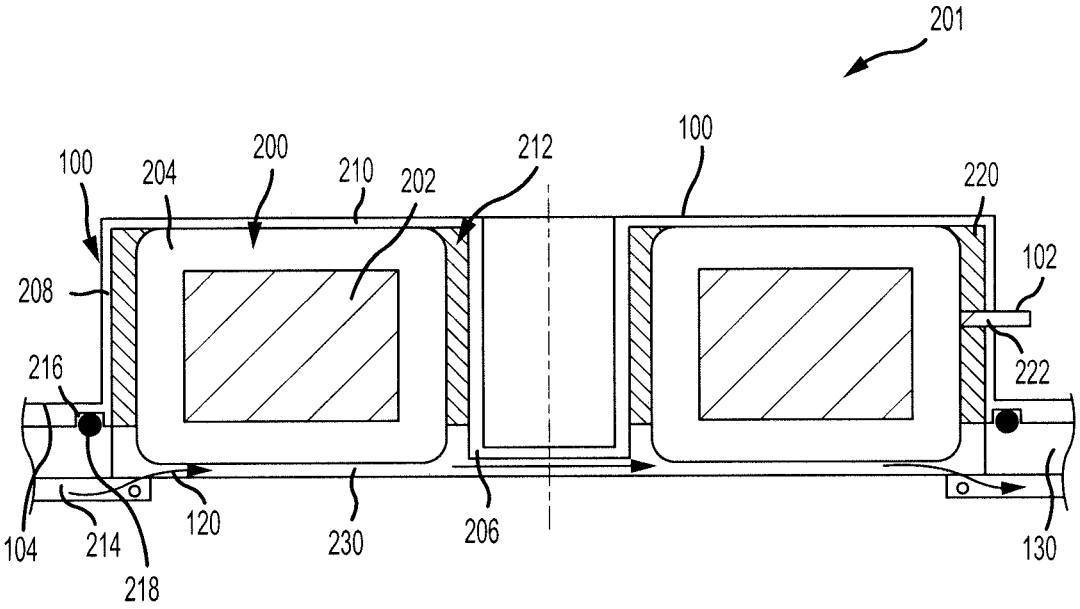
FIG. 2 illustrates a system for cooling an inductor that includes the inductor housing of FIG. 1A, the secondary housing of FIG. 1B, and a toroidal inductor, in accordance with various embodiments of the present disclosure.

Referring now to FIG. 2, a system 201 for cooling an inductor is shown. In various embodiments, the system 201 may be implemented within an aircraft or other environments. The system 201 includes the inductor housing 100, the secondary housing 130, and the toroidal inductor 200. The toroidal inductor 200 includes an annular core 202 with a winding 204 wound around the annular core 202. The winding 204 may include, for example, a metal or other conductive wire wound around the annular core 202. In some embodiments, an electrically insulating material, such as Nomex, Kapton, a thermoplastic bobbin, or other suitable insulator, disposed between the annular core 202 and the winding 204.

The inductor housing 100 includes an inner annular wall 206, an outer annular wall 208, and a third wall 210 extending from the inner annular wall to the outer annular wall 208. The inner annular wall 206, the outer annular wall 208, and the third wall 210 define an annular cavity 212 in which the toroidal inductor 200 may be received. In that regard, the toroidal inductor 200 may be enclosed or encased within the annular cavity 212 by the secondary housing 130.

The secondary housing 130 may include a coolant supply 214 designed to provide a coolant. In that regard, a coolant channel 230 may be defined between the secondary housing 130 and one or both of the toroidal inductor 200 or the inductor housing 100. The coolant may flow from the coolant supply 214 through the coolant channel 230 as shown by arrows 120 such that the coolant physically contacts the winding 204 of the toroidal inductor 200. Because the coolant directly contacts the winding 204, there is direct convection cooling from the winding 204, the annular core 202, and the inductor housing 100 to the coolant. It is desirable for the coolant to have very low electrical conductivity. For example, the coolant may include generator cooling oil, Poly Alpha Olyphene, fuel, Fluorocarbon, or the like.

Conventional component cooling systems do not utilize direct contact between coolant and a corresponding component. Rather, conventional component cooling systems encase the component in a conductive casing. This component with conductive casing is thermally and structurally attached to a cold plate. There is coolant flow inside the cold plate. These systems incur temperature rise from the winding to the case, from the case to the cold plate surface due to thermal interface, and from the cold plate surface to the coolant due to conduction. The system 201, on the other hand, does not incur such temperature rises because the wire 204 of the toroidal inductor 200 is in direct contact with the coolant, thus facilitating direct convective heat transfer between the toroidal inductor 200 and the coolant.

The attachment boss 104 of the inductor housing 100 may define a first O-ring groove 216, and the system 201 may further include a first O-ring 218. The first O-ring 218 may be located within the first O-ring groove 216 and may contact the secondary housing 130. In that regard, the first O-ring 218 may reduce the likelihood of coolant leaking between the inductor housing 100 and the secondary housing 130.

In various embodiments, the system 201 may include a potting material 220 located between the toroidal inductor 200 and the inductor housing 100. For example, the potting material 220 may be located between the inner annular wall 206 and the toroidal inductor 200, and between the outer annular wall 208 and the toroidal inductor 200. The potting material may serve multiple purposes such as providing structural and thermal mounting of the toroidal inductor 200 to the inductor housing 100, and reducing the likelihood of the coolant leaking from the inductor housing 100. As with the coolant, it may be desirable for the potting material 220 to have a relatively low electrical conductivity. For example, the potting material 220 may include an epoxy based potting material, a silicon based potting material, a urethane based potting material, or the like.

At least one of the outer annular wall 208, the inner annular wall 206, or the third wall 210 may define a via 222 through which the lead 102 of the toroidal inductor 200 may extend. The via 222 may be located at a location in which the potting material 220 surrounds the inner edge of the via 222. In that regard, the potting material 220 may reduce the likelihood of the coolant leaking through the via 222.

Figure 3:
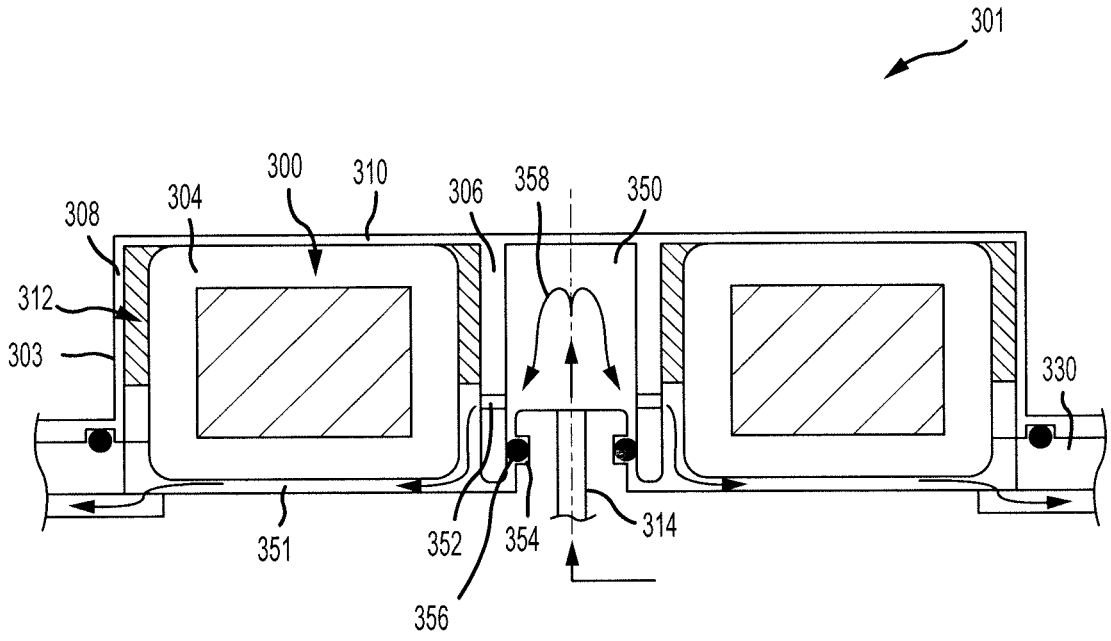
FIG. 3 illustrates a system for cooling an inductor and includes an inductor housing, a secondary housing, and a toroidal inductor, in accordance with various embodiments of the present disclosure.

Turning now to FIG. 3, another system 301 for cooling an inductor is shown. The system 301 includes an inductor housing 303 having an inner annular wall 306, an outer annular wall 308, and a third wall 310 that define an annular cavity 312. The system 301 further includes a toroidal inductor 300 having a winding 304. The system 301 also includes a secondary housing 330. The secondary housing 330 includes a coolant supply 314 that provides a coolant.

The inductor housing 303 includes a coolant channel 350 defined radially inward from the inner annular wall 306, and the inner annular wall 306 defines a coolant hole 352 that extends from the coolant channel 350 to the annular cavity 312. The coolant supply 314 provides the coolant to the coolant channel 350. From the coolant channel 350, the coolant may flow through the coolant hole 352 and into another coolant channel 351 defined between the toroidal inductor 300 and the secondary housing 330, as shown by arrows 358. Where used in this context, the coolant hole 352 may include multiple coolant holes, or a continuous cooling hole, oriented annularly about the inner annular wall 306 and equally spaced from the third wall 310. In that regard, the coolant hole 352 may also be referred to as a set of coolant holes 352. In some embodiments, the multiple holes of the coolant hole 352 may be located in equal angular intervals around the inner annular wall 306. The coolant may contact the winding 304 of the toroidal inductor 300 from the time it enters the annular cavity 312 until it exits the coolant channel 351.

The secondary housing 330 may define a second O-ring groove 354 at a location aligned with the inner annular wall 306. The system 301 may include a second O-ring 356 that is designed to be positioned in the second O-ring groove 354 and to contact the secondary housing 330 and the inner annular wall 306. In that regard, the second O-ring 356 reduces the likelihood of coolant leaking out of the coolant channel 350. That is, the second O-ring 356 reduces the likelihood of coolant leaking between the secondary housing 330 and the inner annular wall 306.

Figure 4:
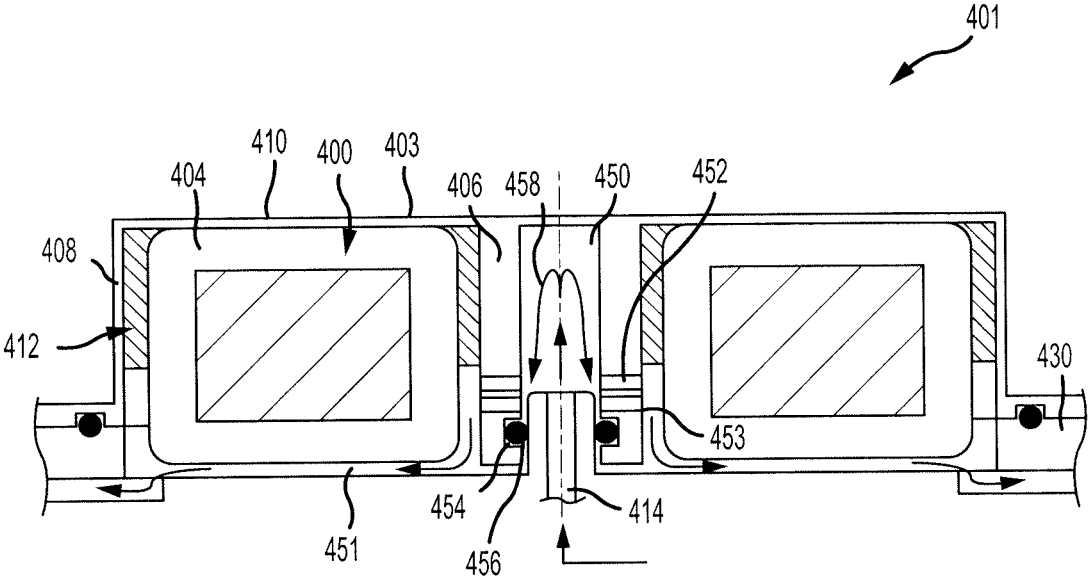
FIG. 4 illustrates a system for cooling an inductor and includes an inductor housing, a secondary housing, and a toroidal inductor, in accordance with various embodiments of the present disclosure.

Turning now to FIG. 4, another system 401 for cooling an inductor is shown. The system 401 includes an inductor housing 403 having an inner annular wall 406, an outer annular wall 408, and a third wall 410 that define an annular cavity 412. The system 401 further includes a toroidal inductor 400 having a winding 404. The system 401 also includes a secondary housing 430. The secondary housing 430 includes a coolant supply 414 that provides a coolant.

The inductor housing 403 includes a coolant channel 450 defined radially inward from the inner annular wall 406, and the inner annular wall 406 defines a first set of coolant holes 452 and a second set of coolant holes 453 that each extend from the coolant channel 450 to the annular cavity 412. The coolant supply 414 provides the coolant to the coolant channel 450. From the coolant channel 450, the coolant may flow through the sets of coolant holes 452, 453 and into another coolant channel 451 defined between the toroidal inductor 400 and the secondary housing 430, as shown by arrows 458. The coolant may contact the winding 404 of the toroidal inductor 400 from the time it enters the annular cavity 412 until it exits the coolant channel 451. Use of multiple sets of coolant holes 452, 453 may facilitate a greater flow of the coolant through the coolant channel 451 relative to use of a single cooling hole.

The inner annular wall 406 of the inductor housing 403 may define a second O-ring groove 454 that is aligned with a portion of the secondary housing 430. The system 401 may further include a second O-ring 456. The second O-ring 456 may be positioned in the second O-ring groove 454 and may contact the inductor housing 403 and the secondary housing 430 to reduce the likelihood of coolant leaking out of the coolant channel 450. In various embodiments, it may be easier to machine the second O-ring groove 454 into the inductor housing 403, as in the system 401, rather than the secondary housing 430.

Figure 5:
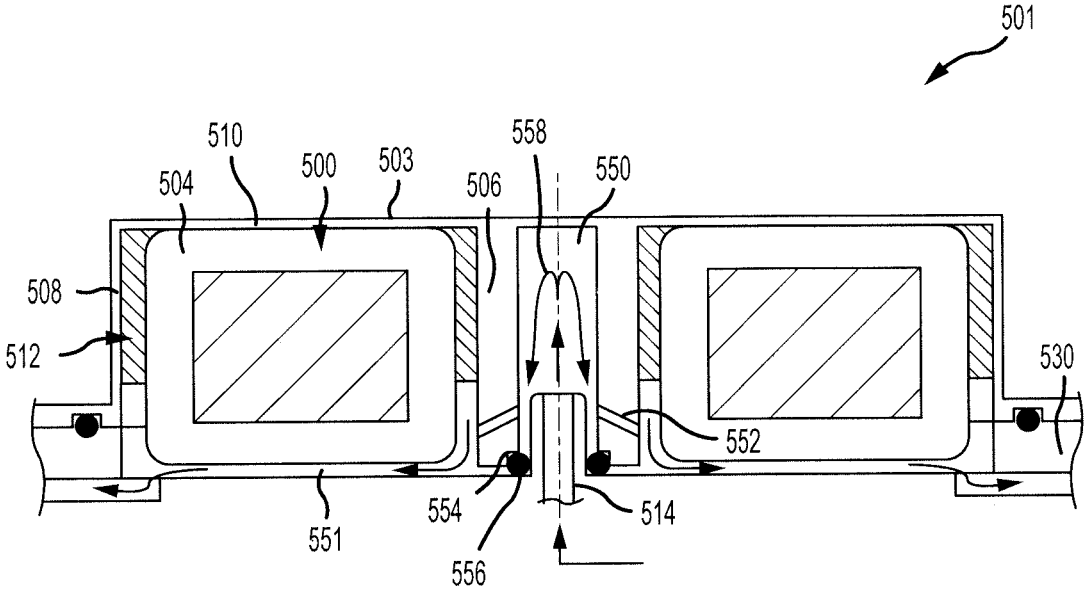
FIG. 5 illustrates a system for cooling an inductor and includes an inductor housing, a secondary housing, and a toroidal inductor, in accordance with various embodiments of the present disclosure.

Turning now to FIG. 5, another system 501 for cooling an inductor is shown. The system 501 includes an inductor housing 503 having an inner annular wall 506, an outer annular wall 508, and a third wall 510 that define an annular cavity 512. The system 501 further includes a toroidal inductor 500 having a winding 504. The system 501 also includes a secondary housing 530. The secondary housing 530 includes a coolant supply 514 that provides a coolant.

The inductor housing 503 includes a coolant channel 550 defined radially inward from the inner annular wall 506, and the inner annular wall 506 defines a set of coolant holes 552 that extends from the coolant channel 550 to the annular cavity 512. The set of coolant holes 552 differs from the cooling holes of previous embodiments because the set of coolant holes 552 may be angled relative to the third wall 510. Stated differently, the set of coolant holes 552 may have an angle that is greater than 0 degrees and less than 90 degrees relative to the third wall. If the inductor housing 503 is relatively small, it may be easier to machine the set of coolant holes 552 having the angle, as shown, due to the size of the machining tools.

The coolant supply 514 provides the coolant to the coolant channel 550. From the coolant channel 550, the coolant may flow through the set of coolant holes 552 and into another coolant channel 551 defined between the toroidal inductor 500 and the secondary housing 530, as shown by arrows 558. The coolant may contact the winding 504 of the toroidal inductor 500 from the time it enters the annular cavity 512 until it exits the coolant channel 451.

The inner annular wall 506 further defines a second O-ring groove 554. The second O-ring groove 554 may be located at an open end of the inner annular wall 506 (i.e., an end of the inner annular wall 506 nearest the secondary housing 530). Due to the exposure of this end of the inner annular wall 506 before connection to the secondary housing, machining of the second O-ring groove 554 at this location may be easier than machining an O-ring groove closer to the third wall 510. The system 501 may further include a second O-ring 556 that may be positioned in the second O-ring groove 554. The second O-ring 556 may contact the inner annular wall 506 and the secondary housing 530 and may reduce the likelihood of coolant leaking out of the coolant channel 550.

Figure 6:
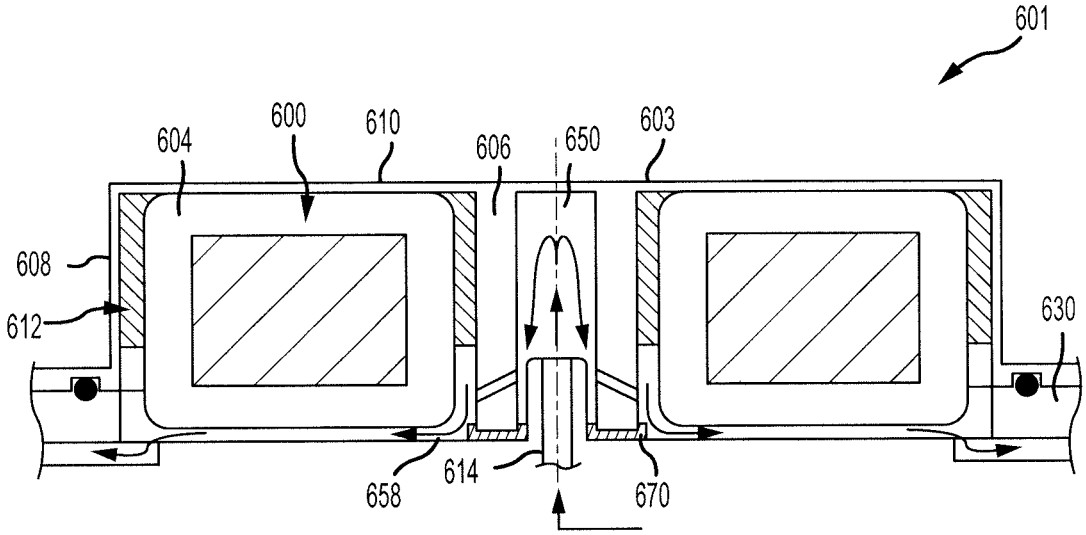
FIG. 6 illustrates a system for cooling an inductor and includes an inductor housing, a secondary housing, and a toroidal inductor, in accordance with various embodiments of the present disclosure.

Turning now to FIG. 6, another system 601 for cooling an inductor is shown. The system 601 includes an inductor housing 603 having an inner annular wall 606, an outer annular wall 608, and a third wall 610 that define an annular cavity 612. The inductor housing 603 further defines a coolant channel 650. The system 601 further includes a toroidal inductor 600 having a winding 604. The system 601 also includes a secondary housing 630. The secondary housing 630 includes a coolant supply 614 that provides a coolant.

The system 601 may be similar to the system 501 of FIG. 5 and coolant may flow through the system 601 in a similar manner, as shown by arrows 658. However, the system 601 may use a face seal 670 in place of the second O-ring 556 of the system 501 of FIG. 5. The face seal 670 may be designed to be compressed between the inner annular wall 606 and the secondary housing 630 in response to the inductor housing 603 being coupled to the secondary housing 630. For example, the face seal 670 may be designed to be between 10 percent (10%) and 75% compressed, between 20% and 60% compressed, or between 30% and 50% compressed in response to the inductor housing 603 being coupled to the secondary housing 630.

Use of the face seal 670 may be advantageous. This is because the face seal 670 can be used without any machining, as opposed to use of an O-ring which may require machining of a corresponding O-ring groove.

Figure 7:
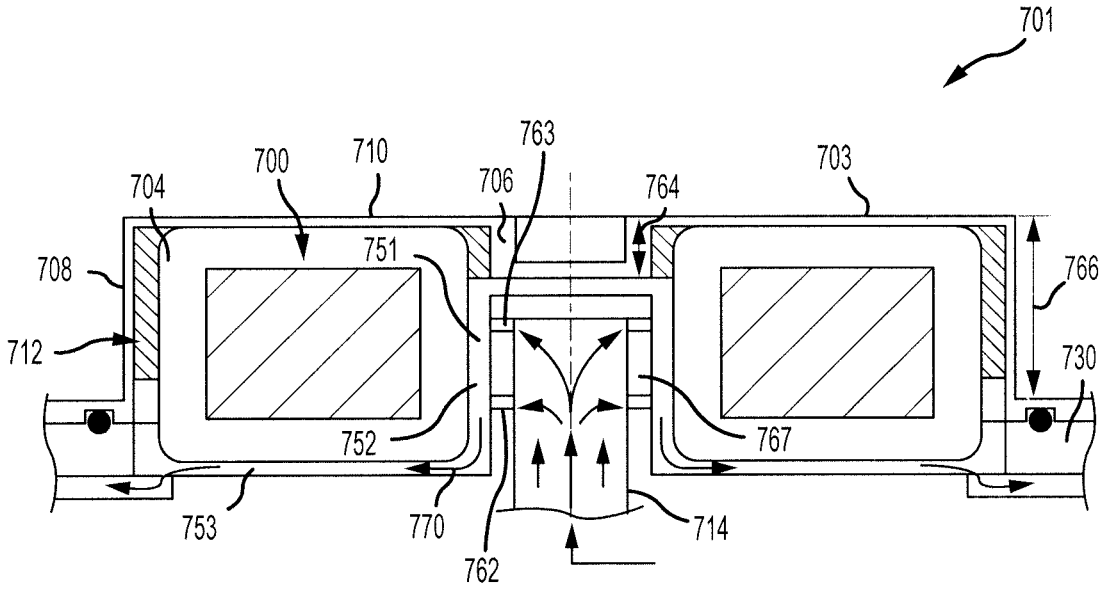
FIG. 7 illustrates a system for cooling an inductor and includes an inductor housing, a secondary housing, and a toroidal inductor, in accordance with various embodiments of the present disclosure.

Turning now to FIG. 7, another system 701 for cooling an inductor is shown. The system 701 includes an inductor housing 703 having an inner annular wall 706, an outer annular wall 708, and a third wall 710 that define an annular cavity 712. The system 701 further includes a toroidal inductor 700 having a winding 704. The system 701 also includes a secondary housing 730. The secondary housing 730 includes a coolant supply 714 that provides a coolant.

The inner annular wall 706 may have a height 764 that is significantly less than a height 766 of the outer annular wall 708. In that regard, a supply opening 767 may be located radially inward from the toroidal inductor 700. The coolant supply 714 of the secondary housing 730 may extend into the supply opening 767 and may include one or more sets of coolant holes 762, 763 that extend from the coolant supply 714 into the annular cavity 712.

By shortening the height 764 of the inner annular wall 706, a greater surface area of the winding 704 is exposed to the coolant, thus increasing heat transfer from the toroidal inductor 700 to the coolant. In particular, a coolant channel 751 may be defined through which the coolant may flow. The coolant channel 751 may include a first portion 752 defined between the toroidal inductor 700 and the coolant supply 714, and may include a second portion 753 defined between the toroidal inductor 700 and the secondary housing 730. The coolant may flow from the coolant supply 714 through the sets of coolant holes 762, 763 and through the coolant channel 751 as shown by arrows 770. The first portion 752 of the coolant channel 751 is caused by reduction of the height 764 of the inner annular wall 706.

Figure 8:
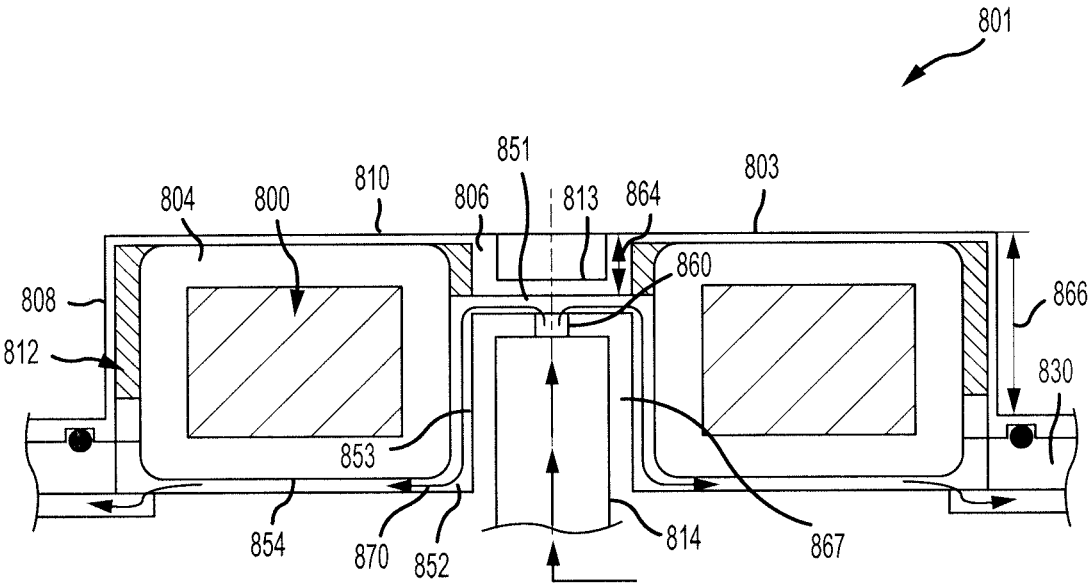
FIG. 8 illustrates a system for cooling an inductor and includes an inductor housing, a secondary housing, and a toroidal inductor, in accordance with various embodiments of the present disclosure.

Turning now to FIG. 8, another system 801 for cooling an inductor is shown. The system 801 includes an inductor housing 803 having an inner annular wall 806, an outer annular wall 808, and a third wall 810 that define an annular cavity 812. The system 801 further includes a toroidal inductor 800 having a winding 804. The system 801 also includes a secondary housing 830. The secondary housing 830 includes a coolant supply 814 that provides a coolant.

The inner annular wall 806 may have a height 864 that is significantly less than a height 866 of the outer annular wall 808. In that regard, a supply opening 867 may be located radially inward from the toroidal inductor 800. The coolant supply 814 of the secondary housing 830 may extend into the supply opening 867 and may include a coolant hole 860 that extends into the supply opening 867.

The inductor housing 803 further includes a fourth wall 813 extending radially inward from the inner annular wall 806. In that regard, a coolant flowpath 851 is defined between the coolant supply 814 of the secondary housing 830 and the fourth wall 813. Coolant may flow from the coolant supply 814 through the coolant hole 860 and into the coolant flowpath 851. From the coolant flowpath 851, the coolant may flow into a coolant channel 852 having a first portion 853 and a second portion 854, as shown by arrows 870.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An inductor housing for housing an inductor having a core and a winding, the inductor housing comprising:

an outer annular wall and a third wall extending inward from the outer annular wall such that the outer annular wall and the third wall at least partially define an annular cavity configured to receive the inductor;

an attachment feature configured to couple the inductor housing to a secondary housing and including an attachment boss defining a first O-ring groove, the attachment boss extending from the outer annular wall away from the annular cavity;

a first O-ring configured to be received by the first O-ring groove for resisting a flow of fluid between the attachment boss and the secondary housing; and a coolant channel for receiving coolant from a coolant supply, wherein:

the inductor is configured to be enclosed within the annular cavity and the secondary housing, and the coolant from a coolant supply is configured to flow into the annular cavity via the coolant channel and to contact the winding of the inductor.

2. The inductor housing of claim 1, further comprising an inner annular wall located radially inward from the outer annular wall and at least partially defining the annular cavity, and a fourth wall extending radially inward from the inner annular wall such that a coolant flowpath is defined between the secondary housing and the fourth wall such that the coolant flows from the coolant supply into the coolant flowpath, and from the coolant flowpath into the annular cavity via the coolant channel and past the winding of the inductor.

3. The inductor housing of claim 1, further comprising an inner annular wall located radially inward from the outer annular wall and at least partially defining the annular cavity, and a potting material configured to be positioned between the inductor and the inner annular wall, and between the inductor and the outer annular wall.

4. The inductor housing of claim 3, wherein the outer annular wall defines a via configured to receive a lead of the inductor such that the lead extends through the potting material and the via, the potting material reducing the likelihood of the coolant leaking through the via.

5. The inductor housing of claim 1, further comprising an inner annular wall located radially inward from the outer annular wall and at least partially defining the annular cavity, and a coolant channel defined radially inward from the inner annular wall, wherein the inner annular wall further defines a coolant hole in fluid communication with the coolant channel such that the coolant is configured to flow from the coolant supply, through the coolant channel and the coolant hole and towards the outer annular wall.

6. The inductor housing of claim 5, wherein the inner annular wall further defines a second O-ring groove configured to receive a second O-ring to reduce the likelihood of the coolant leaking between the inner annular wall and the secondary housing.

7. The inductor housing of claim 5, wherein the coolant hole includes multiple sets of coolant holes.

8. The inductor housing of claim 5, wherein the coolant hole forms an angle that is greater than 0 degrees and less than 90 degrees relative to the third wall.

9. The inductor housing of claim 5, further comprising a face seal configured to be compressed between the inner annular wall and the secondary housing to reduce the likelihood of the coolant leaking between the inner annular wall and the secondary housing.

10. A system for cooling electronics, comprising:

a coolant supply for providing a coolant;

an inductor having a core and a winding;

an inductor housing defining a cavity having a shape configured to at least partially receive the inductor and having:

an inner annular wall, an outer annular wall, a third wall extending from the inner annular wall to the outer annular wall such that the inner annular wall, the outer annular wall, and the third wall define the cavity, and an attachment boss extending away from the outer annular wall and defining a first O-ring groove, the attachment boss extending from the outer annular wall away from the annular cavity;

a secondary housing shaped and configured to be sealingly attached to the attachment boss of the inductor housing and defining a coolant flowpath in fluid communication with the coolant supply to facilitate coolant flow within the secondary housing fluidically engaging with the winding; and a first O-ring configured to be received by the first O-ring groove for resisting leakage of the coolant between the attachment boss and the secondary housing.

11. The system of claim 10, further comprising a potting material located between the inductor and the outer annular wall, wherein the outer annular wall defines a via configured to receive a lead of the inductor such that the lead extends through the potting material and the via, the potting material reducing the likelihood of the coolant leaking through the via.

12. The system of claim 10, further comprising a coolant channel defined radially inward from the inner annular wall, wherein the inner annular wall further defines a coolant hole configured to receive the coolant from the secondary housing.

13. A system for cooling an inductor having a winding, comprising:

a secondary housing having a coolant supply for providing a coolant;

an inductor housing defining a cavity having a shape configured to at least partially receive the inductor and having:

an attachment feature configured to couple the inductor housing to the secondary housing, such that the coolant may flow from the secondary housing through at least a portion of the cavity and contact the winding, an inner annular wall, an outer annular wall, a third wall extending from the inner annular wall to the outer annular wall such that the inner annular wall, the outer annular wall, and the third wall define the cavity, and an attachment boss extending away from the outer annular wall, configured to be coupled to the secondary housing, and defining a first O-ring groove, the attachment boss extending from the outer annular wall away from the annular cavity; and a first O-ring configured to be received by the first O-ring groove for resisting leakage of the coolant between the attachment boss and the secondary housing.

14. The system of claim 13, further comprising a potting material configured to be located between the inductor and the outer annular wall, wherein the outer annular wall defines a via configured to receive a lead of the inductor such that the lead extends through the potting material and the via, the potting material reducing the likelihood of the coolant leaking through the via.

* * * * *